US012741778B2

(12) United States Patent
Zwaga

(10) Patent No.: US 12,741,778 B2
(45) **Date of Patent: *Sep. 22, 2026**

(54) CARDBOARD TRAY

(71) Applicant: Stackpack B.V., Almelo (NL)

(72) Inventor: Ronald Zwaga, Almelo (NL)

(73) Assignee: Stackpack B.V., Almelo (NL)

( * ) Notice: Subject to any disclaimer, the term of this patent is extended or adjusted under 35 U.S.C. 154(b) by 73 days.

This patent is subject to a terminal disclaimer.

(21) Appl. No.: 18/289,420

(22) PCT Filed: Mar. 31, 2022

(86) PCT No.: PCT/EP2022/058644
§ 371 (c)(1),
(2) Date: Nov. 3, 2023

(87) PCT Pub. No.: WO2022/233509
PCT Pub. Date: Nov. 10, 2022

(65) Prior Publication Data

US 2024/0246717 A1 Jul. 25, 2024

(30) Foreign Application Priority Data

May 6, 2021 (EP) ..... 21172491

(51) Int. Cl.
*B65D 5/24* (2006.01)
*B65D 5/20* (2006.01)
*B65D 5/56* (2006.01)

(52) U.S. Cl.
CPC ..... *B65D 5/243* (2013.01); *B65D 5/2047* (2013.01); *B65D 5/563* (2013.01)

(58) Field of Classification Search
CPC ..... B65D 1/0215; B65D 1/0223; B65D 1/10; B65D 1/22; B65D 1/243; B65D 1/26;
(Continued)

(56) References Cited

U.S. PATENT DOCUMENTS 2,321,536 A * 6/1943 Wells ..... B65D 5/323 229/122.23
2,519,831 A * 8/1950 Frankenstein ..... B65D 5/2009 229/172

(Continued)

FOREIGN PATENT DOCUMENTS

DE 3814520 A1 * 11/1989 ..... B65D 1/46
EP 0413094 A1 * 2/1991 ..... B65D 5/246

(Continued)

*Primary Examiner* — Anthony D Stashick
*Assistant Examiner* — Marcos Javier Rodriguez Molina
(74) *Attorney, Agent, or Firm* — The Webb Law Firm

(57) ABSTRACT

The invention relates to a cardboard tray folded from an unfolded sheet of cardboard, which tray includes a bottom wall with a circumferential edge composed out of a number of straight edges; wall parts each arranged to a straight edge of the bottom wall; first flange parts at least arranged to opposite wall parts along the circumferential edge, which first flange parts are arranged to an edge of said wall part opposite of, and preferably parallel to, the respective straight edge of the bottom wall. The first flange parts include at least a first, a second and third elongate flange part section, which are connected parallel and along an elongate edge to each other. For each first flange part, the first elongate flange part section is arranged to a respective wall part, the second elongate flange part section is double folded against the first elongate flange part section, and the third elongate flange part section is connected parallel and along an elongate edge to the second elongate flange part section. For each first flange part the third elongate flange part section is adhered to the respective wall part on the inside of the cardboard tray and the second elongate flange part section is sloping downwards from the third elongate flange part section towards the first elongate flange part section.

10 Claims, 7 Drawing Sheets

(58) Field of Classification Search

CPC . B65D 1/265; B65D 1/30; B65D 1/34; B65D 1/36; B65D 1/40; B65D 1/42; B65D 1/44; B65D 1/48; B65D 11/02; B65D 11/10; B65D 11/1833; B65D 13/04; B65D 15/04; B65D 15/08; B65D 15/22; B65D 15/24; B65D 17/4011; B65D 19/00; B65D 19/0002; B65D 19/0012; B65D 19/0016; B65D 19/0026; B65D 19/0028; B65D 19/0069; B65D 19/0095; B65D 19/06; B65D 19/12; B65D 19/20; B65D 19/38; B65D 19/385; B65D 19/40; B65D 19/44; B65D 21/02; B65D 21/0201; B65D 21/0209; B65D 21/0212; B65D 21/0213; B65D 21/0219; B65D 21/0224; B65D 21/0226; B65D 21/0231; B65D 21/0233; B65D 21/045; B65D 21/048; B65D 21/062; B65D 21/066; B65D 2203/00; B65D 2203/02; B65D 2203/10; B65D 2203/12; B65D 2205/00; B65D 2205/02; B65D 2207/00; B65D 2211/00; B65D 2215/02; B65D 2251/0018; B65D 2251/1016; B65D 2251/105; B65D 23/00; B65D 23/0828; B65D 2301/10; B65D 2301/20; B65D 2313/00; B65D 2313/04; B65D 2313/10; B65D 2401/15; B65D 25/00; B65D 25/02; B65D 25/04; B65D 25/10; B65D 25/101; B65D 25/108; B65D 25/14; B65D 25/16; B65D 25/20; B65D 25/205; B65D 25/24; B65D 25/28; B65D 25/2867; B65D 25/2876; B65D 25/34; B65D 25/36; B65D 25/54; B65D 2501/0081; B65D 2501/24019; B65D 2501/24108; B65D 2501/2435; B65D 2519/00019; B65D 2519/00024; B65D 2519/00029; B65D 2519/00034; B65D 2519/00044; B65D 2519/00054; B65D 2519/00059; B65D 2519/00064; B65D 2519/00069; B65D 2519/00089; B65D 2519/00094; B65D 2519/00099; B65D 2519/00104; B65D 2519/00124; B65D 2519/00139; B65D 2519/00159; B65D 2519/00194; B65D 2519/00268; B65D 2519/00273; B65D 2519/00278; B65D 2519/00288; B65D 2519/00293; B65D 2519/00298; B65D 2519/00308; B65D 2519/00318; B65D 2519/00323; B65D 2519/00333; B65D 2519/00338; B65D 2519/00343; B65D 2519/00348; B65D 2519/00373; B65D 2519/00378; B65D 2519/00432; B65D 2519/00437; B65D 2519/00442; B65D 2519/00447; B65D 2519/00497; B65D 2519/00502; B65D 2519/00557; B65D 2519/00562; B65D 2519/00567; B65D 2519/00572; B65D 2519/00597; B65D 2519/00621; B65D 2519/00641; B65D 2519/00661; B65D 2519/00666; B65D 2519/00711; B65D 2519/00726; B65D 2519/00805; B65D 2519/0081; B65D 2519/00815; B65D 2519/0086; B65D 2519/0091; B65D 2519/00915; B65D 2543/00027; B65D 2543/00083; B65D 2543/00092; B65D 2543/00194; B65D 2543/00268; B65D 2543/00296; B65D 2543/00333; B65D 2543/00351; B65D 2543/00361; B65D 2543/00425; B65D 2543/00509; B65D 2543/00527; B65D 2543/00537; B65D 2543/00546; B65D 2543/00555; B65D 2543/00574; B65D 2543/00629; B65D 2543/00648; B65D 2543/00685; B65D 2543/00694; B65D 2543/00731; B65D 2543/00759; B65D 2543/00796; B65D 2543/00805; B65D 2543/00842; B65D 2565/385; B65D 2565/386; B65D 2565/387; B65D 2565/388; B65D 2571/00018; B65D 2571/00037; B65D 2571/00043; B65D 2571/00055; B65D 2571/00061; B65D 2571/00141; B65D 2571/00148; B65D 2571/00154; B65D 2571/0016; B65D 2571/00185; B65D 2571/00265; B65D 2571/00277; B65D 2571/0029; B65D 2571/00302; B65D 2571/00314; B65D 2571/00339; B65D 2571/0037; B65D 2571/00388; B65D 2571/00401; B65D 2571/00444; B65D 2571/0045; B65D 2571/00456; B65D 2571/00462; B65D 2571/00469; B65D 2571/00475; B65D 2571/00487; B65D 2571/00493; B65D 2571/00506; B65D 2571/00512; B65D 2571/00524; B65D 2571/00543; B65D 2571/00549; B65D 2571/00567; B65D 2571/00574; B65D 2571/0058; B65D 2571/00617; B65D 2571/0066; B65D 2571/00666; B65D 2571/00716; B65D 2571/00728; B65D 2571/00753; B65D 2571/00759; B65D 2571/0079; B65D 2571/00796; B65D 2571/00802; B65D 2571/00808; B65D 2571/00814; B65D 2571/00845; B65D 2571/00864; B65D 2571/0087; B65D 2571/00882; B65D 2571/00925; B65D 2571/00932; B65D 2571/00993; B65D 2575/3245; B65D 2575/586; B65D 2577/043; B65D 2577/045; B65D 2577/047; B65D 2577/2025; B65D 2577/205; B65D 2577/2066; B65D 2577/2091; B65D 2581/053; B65D 2581/34; B65D 2581/3404; B65D 2581/3405; B65D 2581/3406; B65D 2581/3412; B65D 2581/3413; B65D 2581/3416; B65D 2581/3422; B65D 2581/3425; B65D 2581/3432; B65D 2581/3433; B65D 2581/3437; B65D 2581/344; B65D 2581/3441; B65D 2581/3444; B65D 2581/3445; B65D 2581/3447; B65D 2581/3452; B65D 2581/3454; B65D 2581/3455; B65D 2581/3456; B65D 2581/3458; B65D 2581/346; B65D 2581/3462; B65D 2581/3464; B65D 2581/3466; B65D 2581/3467; B65D 2581/3468; B65D 2581/3472; B65D 2581/3474; B65D 2581/3477; B65D 2581/3478; B65D 2581/3479; B65D 2581/3481; B65D 2581/3483; B65D 2581/3487; B65D 2581/3489; B65D 2581/349; B65D 2581/3491; B65D 2581/3493; B65D 2581/3494; B65D 2581/3495; B65D

2581/3497; B65D 2581/3498; B65D 2585/366; B65D 2585/545; B65D 2585/647; B65D 2585/6855; B65D 2585/689; B65D 2585/88; B65D 27/00; B65D 27/14; B65D 3/06; B65D 3/08; B65D 3/22; B65D 31/00; B65D 31/16; B65D 31/18; B65D 33/00; B65D 33/004; B65D 33/008; B65D 33/02; B65D 33/20; B65D 33/22; B65D 35/10; B65D 37/00; B65D 43/02; B65D 43/0204; B65D 43/0212; B65D 43/0214; B65D 43/06; B65D 43/16; B65D 43/162; B65D 43/169; B65D 43/22; B65D 47/06; B65D 5/00; B65D 5/0005; B65D 5/001; B65D 5/0015; B65D 5/002; B65D 5/0025; B65D 5/003; B65D 5/0035; B65D 5/004; B65D 5/0045; B65D 5/005; B65D 5/006; B65D 5/0065; B65D 5/0075; B65D 5/0085; B65D 5/02; B65D 5/0209; B65D 5/0227; B65D 5/0236; B65D 5/0254; B65D 5/029; B65D 5/06; B65D 5/064; B65D 5/067; B65D 5/08; B65D 5/10; B65D 5/12; B65D 5/14; B65D 5/16; B65D 5/18; B65D 5/20; B65D 5/2004; B65D 5/2009; B65D 5/2014; B65D 5/2019; B65D 5/2023; B65D 5/2028; B65D 5/2033; B65D 5/2038; B65D 5/2042; B65D 5/2047; B65D 5/2052; B65D 5/2057; B65D 5/2076; B65D 5/2085; B65D 5/209; B65D 5/2095; B65D 5/22; B65D 5/24; B65D 5/241; B65D 5/242; B65D 5/243; B65D 5/244; B65D 5/245; B65D 5/246; B65D 5/247; B65D 5/248; B65D 5/26; B65D 5/28; B65D 5/30; B65D 5/302; B65D 5/304; B65D 5/32; B65D 5/321; B65D 5/322; B65D 5/323; B65D 5/324; B65D 5/326; B65D 5/328; B65D 5/36; B65D 5/3621; B65D 5/3635; B65D 5/3642; B65D 5/365; B65D 5/3657; B65D 5/3664; B65D 5/3685; B65D 5/38; B65D 5/40; B65D 5/42; B65D 5/4204; B65D 5/4208; B65D 5/4212; B65D 5/4216; B65D 5/4229; B65D 5/4233; B65D 5/425; B65D 5/4266; B65D 5/427; B65D 5/4279; B65D 5/4295; B65D 5/44; B65D 5/441; B65D 5/443; B65D 5/445; B65D 5/446; B65D 5/448; B65D 5/46; B65D 5/46016; B65D 5/46072; B65D 5/4608; B65D 5/46096; B65D 5/4612; B65D 5/46192; B65D 5/48; B65D 5/48002; B65D 5/48014; B65D 5/48018; B65D 5/4802; B65D 5/48022; B65D 5/48024; B65D 5/48026; B65D 5/4803; B65D 5/48034; B65D 5/48038; B65D 5/4804; B65D 5/48042; B65D 5/48046; B65D 5/48048; B65D 5/50; B65D 5/5007; B65D 5/5014; B65D 5/5016; B65D 5/5019; B65D 5/5021; B65D 5/5023; B65D 5/5028; B65D 5/503; B65D 5/5035; B65D 5/5038; B65D 5/504; B65D 5/5059; B65D 5/509; B65D 5/52; B65D 5/5206; B65D 5/5213; B65D 5/5253; B65D 5/5266; B65D 5/5273; B65D 5/5286; B65D 5/54; B65D 5/5405; B65D 5/541; B65D 5/5415; B65D 5/542; B65D 5/5445; B65D 5/545; B65D 5/5455; B65D 5/546; B65D 5/5475; B65D 5/548; B65D 5/5495; B65D 5/56; B65D 5/563; B65D 5/566; B65D 5/60; B65D 5/603; B65D 5/62; B65D 5/64; B65D 5/643; B65D 5/66; B65D 5/6608; B65D 5/6626; B65D 5/6632; B65D 5/6635; B65D 5/6638; B65D 5/6644; B65D 5/665; B65D 5/6652; B65D 5/6655; B65D 5/6658; B65D 5/6661; B65D 5/6664; B65D 5/6667; B65D 5/667; B65D 5/6685; B65D 5/6697; B65D 5/68; B65D 5/685; B65D 5/72; B65D 5/721; B65D 5/724; B65D 5/725; B65D 5/728; B65D 51/20; B65D 51/245; B65D 51/247; B65D 51/28; B65D 55/024; B65D 59/04; B65D 61/00; B65D 63/109; B65D 65/00; B65D 65/14; B65D 65/22; B65D 65/38; B65D 65/40; B65D 65/403; B65D 65/42; B65D 65/46; B65D 65/463; B65D 65/466; B65D 67/02; B65D 71/00; B65D 71/0003; B65D 71/0007; B65D 71/0018; B65D 71/0022; B65D 71/0085; B65D 71/0088; B65D 71/0096; B65D 71/02; B65D 71/04; B65D 71/063; B65D 71/066; B65D 71/08; B65D 71/10; B65D 71/14; B65D 71/16; B65D 71/30; B65D 71/34; B65D 71/36; B65D 71/38; B65D 71/40; B65D 71/406; B65D 71/42; B65D 71/46; B65D 71/50; B65D 71/504; B65D 71/70; B65D 71/72; B65D 73/0057; B65D 73/0092; B65D 75/00; B65D 75/002; B65D 75/004; B65D 75/008; B65D 75/04; B65D 75/08; B65D 75/12; B65D 75/14; B65D 75/16; B65D 75/20; B65D 75/30; B65D 75/305; B65D 75/32; B65D 75/326; B65D 75/327; B65D 75/36; B65D 75/366; B65D 75/367; B65D 75/38; B65D 75/52; B65D 75/522; B65D 75/525; B65D 75/527; B65D 75/54; B65D 75/566; B65D 75/58; B65D 75/5805; B65D 75/5827; B65D 75/5833; B65D 75/5838; B65D 75/5855; B65D 75/5866; B65D 75/5877; B65D 75/5883; B65D 75/5894; B65D 75/66; B65D 77/003; B65D 77/02; B65D 77/04; B65D 77/0406; B65D 77/0413; B65D 77/042; B65D 77/0426; B65D 77/0433; B65D 77/0453; B65D 77/046; B65D 77/062; B65D 77/065; B65D 77/20; B65D 77/2016; B65D 77/2024; B65D 77/2032; B65D 77/2056; B65D 77/208; B65D 77/2088; B65D 77/24; B65D 77/245; B65D 77/26; B65D 77/30; B65D 77/32; B65D 77/38; B65D 79/02; B65D 81/00; B65D 81/02; B65D 81/025; B65D 81/03; B65D 81/05; B65D 81/052; B65D 81/053; B65D 81/055; B65D 81/056; B65D 81/057; B65D 81/058; B65D 81/107; B65D 81/113; B65D 81/133; B65D 81/18; B65D 81/20; B65D 81/2015; B65D 81/203; B65D 81/2038; B65D 81/2069; B65D 81/2076; B65D

81/2084; B65D 81/24; B65D 81/26; B65D 81/261; B65D 81/262; B65D 81/263; B65D 81/264; B65D 81/265; B65D 81/266; B65D 81/267; B65D 81/268; B65D 81/28; B65D 81/32; B65D 81/3205; B65D 81/3216; B65D 81/3261; B65D 81/3288; B65D 81/3294; B65D 81/34; B65D 81/343; B65D 81/3446; B65D 81/3453; B65D 81/3461; B65D 81/36; B65D 81/368; B65D 81/38; B65D 81/3823; B65D 81/3825; B65D 81/3865; B65D 81/3869; B65D 81/3874; B65D 81/3876; B65D 81/3881; B65D 81/3886; B65D 81/3893; B65D 83/00; B65D 83/0445; B65D 83/0463; B65D 83/06; B65D 83/08; B65D 83/0805; B65D 83/0858; B65D 83/7713; B65D 85/00; B65D 85/07; B65D 85/10; B65D 85/10568; B65D 85/20; B65D 85/30; B65D 85/32; B65D 85/321; B65D 85/322; B65D 85/324; B65D 85/327; B65D 85/34; B65D 85/345; B65D 85/36; B65D 85/42; B65D 85/46; B65D 85/48; B65D 85/50; B65D 85/505; B65D 85/52; B65D 85/60; B65D 85/62; B65D 85/68; B65D 85/70; B65D 85/72; B65D 85/76; B65D 85/8061; B65D 85/812; B65D 1/00; B65D 1/02; B65D 1/0207; B65D 1/023; B65D 1/225; B65D 1/24; B65D 1/28; B65D 1/32; B65D 1/46; B65D 11/00; B65D 11/04; B65D 11/16; B65D 11/188; B65D 15/00; B65D 15/02; B65D 15/20; B65D 17/28; B65D 17/34; B65D 17/4012; B65D 17/404; B65D 17/462; B65D 17/50; B65D 17/502; B65D 19/0006; B65D 19/0018; B65D 19/004; B65D 19/0048; B65D 19/04; B65D 19/14; B65D 19/18; B65D 19/42; B65D 21/00; B65D 21/0202; B65D 21/0204; B65D 21/0205; B65D 21/0206; B65D 21/0208; B65D 21/0215; B65D 21/0217; B65D 21/0222; B65D 21/0223; B65D 21/0228; B65D 21/0234; B65D 21/0235; B65D 21/0238; B65D 21/041; B65D 21/046; B65D 21/06; B65D 21/064; B65D 21/083; B65D 21/086; B65D 2203/04; B65D 2203/045; B65D 2203/06; B65D 2205/025; B65D 2209/00; B65D 2231/005; B65D 2231/022; B65D 2231/027; B65D 2251/0003; B65D 2251/0015; B65D 2251/0021; B65D 2251/0025; B65D 2251/0028; B65D 2251/0031; B65D 2251/0081; B65D 2251/009; B65D 2251/0093; B65D 2251/02; B65D 2251/1025; B65D 2251/1041; B65D 2251/20; B65D 2251/205; B65D 2255/06; B65D 2275/02; B65D 2313/02; B65D 2313/08; B65D 2401/00; B65D 2401/05; B65D 2401/10; B65D 2401/20; B65D 2401/55; B65D 2401/60; B65D 25/005; B65D 25/06; B65D 25/08; B65D 25/087; B65D 25/22; B65D 25/2811; B65D 25/2814; B65D 25/282; B65D 25/2823; B65D 25/2835; B65D 25/2838; B65D 25/2882; B65D 25/2885; B65D 25/2888; B65D 25/2897; B65D 25/30; B65D 25/42; B65D 25/56; B65D 2501/009; B65D 2501/24038; B65D 2501/24127; B65D 2501/24305; B65D 2501/24687; B65D 2517/0004; B65D 2517/0017; B65D 2517/0049; B65D 2517/5032; B65D 2517/5086; B65D 2519/00079; B65D 2519/00129; B65D 2519/00169; B65D 2519/00174; B65D 2519/00184; B65D 2519/00208; B65D 2519/00363; B65D 2519/00407; B65D 2519/00452; B65D 2519/00457; B65D 2519/00512; B65D 2519/00587; B65D 2519/00761; B65D 2519/00771; B65D 2519/00776; B65D 2519/00786; B65D 2519/00791; B65D 2519/00796; B65D 2519/008; B65D 2519/0082; B65D 2519/0094; B65D 2519/0096; B65D 2519/0099; B65D 2525/285; B65D 2543/00037; B65D 2543/00046; B65D 2543/00064; B65D 2543/00074; B65D 2543/00101; B65D 2543/00138; B65D 2543/00148; B65D 2543/00175; B65D 2543/00212; B65D 2543/00231; B65D 2543/0024; B65D 2543/0025; B65D 2543/00277; B65D 2543/00305; B65D 2543/00314; B65D 2543/0037; B65D 2543/00398; B65D 2543/00416; B65D 2543/00435; B65D 2543/00444; B65D 2543/00453; B65D 2543/00462; B65D 2543/0049; B65D 2543/005; B65D 2543/00518; B65D 2543/00583; B65D 2543/00592; B65D 2543/00611; B65D 2543/0062; B65D 2543/00638; B65D 2543/00657; B65D 2543/00666; B65D 2543/00703; B65D 2543/00712; B65D 2543/00722; B65D 2543/0074; B65D 2543/0075; B65D 2543/00768; B65D 2543/00777; B65D 2543/00787; B65D 2543/00814; B65D 2543/00851; B65D 2543/00898; B65D 2543/00907; B65D 2543/00972; B65D 2565/00; B65D 2565/38; B65D 2565/381; B65D 2565/382; B65D 2565/383; B65D 2565/384; B65D 2571/00074; B65D 2571/00111; B65D 2571/00253; B65D 2571/00271; B65D 2571/00283; B65D 2571/0032; B65D 2571/00333; B65D 2571/00351; B65D 2571/00382; B65D 2571/00407; B65D 2571/00851; B65D 2571/00901; B65D 2571/00919; B65D 2571/00981; B65D 2575/3218; B65D 2575/362; B65D 2575/365; B65D 2575/368; B65D 2575/565; B65D 2577/00; B65D 2577/042; B65D 2577/2033; B65D 2577/2041; B65D 2577/2058; B65D 2577/2075; B65D 2577/2083; B65D 2581/051; B65D 2581/052; B65D 2581/055; B65D 2581/056; B65D 2581/3401; B65D 2581/3402; B65D 2581/3408; B65D 2581/341; B65D 2581/3417; B65D 2581/3421; B65D 2581/3427; B65D 2581/3428; B65D 2581/3429; B65D 2581/3431; B65D 2581/3435; B65D

2581/3436; B65D 2581/3439; B65D 2581/3443; B65D 2581/3448; B65D 2581/345; B65D 2581/347; B65D 2581/3471; B65D 2581/3475; B65D 2581/3482; B65D 2581/3485; B65D 2583/085; B65D 2585/30; B65D 2585/36; B65D 2585/363; B65D 2585/56; B65D 2585/6837; B65D 27/12; B65D 27/18; B65D 3/00; B65D 3/04; B65D 3/12; B65D 3/14; B65D 3/24; B65D 3/263; B65D 3/268; B65D 3/28; B65D 31/005; B65D 31/02; B65D 31/06; B65D 31/10; B65D 31/12; B65D 31/147; B65D 33/005; B65D 33/007; B65D 33/01; B65D 33/04; B65D 33/06; B65D 33/065; B65D 33/12; B65D 33/16; B65D 33/18; B65D 33/24; B65D 33/2508; B65D 33/28; B65D 35/24; B65D 35/46; B65D 39/00; B65D 39/0017; B65D 41/0442; B65D 41/14; B65D 41/18; B65D 41/32; B65D 41/46; B65D 43/00; B65D 43/0202; B65D 43/0206; B65D 43/0208; B65D 43/021; B65D 43/0216; B65D 43/0218; B65D 43/022; B65D 43/0222; B65D 43/0225; B65D 43/0256; B65D 43/0268; B65D 43/0274; B65D 43/12; B65D 43/164; B65D 43/262; B65D 45/16; B65D 45/18; B65D 45/20; B65D 47/00; B65D 47/0838; B65D 47/0857; B65D 47/2031; B65D 47/265; B65D 47/32; B65D 5/008; B65D 5/009; B65D 5/0263; B65D 5/0272; B65D 5/0281; B65D 5/04; B65D 5/061; B65D 5/068; B65D 5/069; B65D 5/103; B65D 5/106; B65D 5/2061; B65D 5/2066; B65D 5/307; B65D 5/308; B65D 5/3607; B65D 5/3614; B65D 5/3628; B65D 5/422; B65D 5/4225; B65D 5/4237; B65D 5/4245; B65D 5/4275; B65D 5/4283; B65D 5/46008; B65D 5/46024; B65D 5/46032; B65D 5/4604; B65D 5/46056; B65D 5/46088; B65D 5/46112; B65D 5/46128; B65D 5/46144; B65D 5/46152; B65D 5/46184; B65D 5/48004; B65D 5/48008; B65D 5/48012; B65D 5/48016; B65D 5/5002; B65D 5/5004; B65D 5/5011; B65D 5/5033; B65D 5/5054; B65D 5/5069; B65D 5/5085; B65D 5/522; B65D 5/5226; B65D 5/5233; B65D 5/5246; B65D 5/526; B65D 5/528; B65D 5/5425; B65D 5/543; B65D 5/5435; B65D 5/58; B65D 5/606; B65D 5/6614; B65D 5/6629; B65D 5/6641; B65D 5/6673; B65D 5/6676; B65D 5/6682; B65D 5/705; B65D 5/723; B65D 5/726; B65D 50/00; B65D 51/005; B65D 51/04; B65D 51/14; B65D 51/16; B65D 51/1616; B65D 51/1622; B65D 51/1666; B65D 51/1683; B65D 51/18; B65D 51/185; B65D 51/24; B65D 51/242; B65D 51/246; B65D 51/248; B65D 51/249; B65D 51/2807; B65D 51/2878; B65D 53/00; B65D 53/02; B65D 55/02; B65D 55/026; B65D 55/06; B65D 55/14; B65D 55/16; B65D 57/00; B65D 57/003; B65D 65/02; B65D 65/04; B65D 65/06; B65D 65/10; B65D 65/12; B65D 65/16; B65D 65/20; B65D 65/24; B65D 65/406; B65D 67/00; B65D 69/00; B65D 7/06; B65D 7/08; B65D 7/26; B65D 71/0014; B65D 71/0029; B65D 71/0037; B65D 71/004; B65D 71/0048; B65D 71/0062; B65D 71/0077; B65D 71/06; B65D 71/12; B65D 71/18; B65D 71/20; B65D 71/22; B65D 71/243; B65D 71/246; B65D 71/48; B65D 71/508; B65D 73/0028; B65D 75/006; B65D 75/02; B65D 75/24; B65D 75/26; B65D 75/28; B65D 75/322; B65D 75/323; B65D 75/325; B65D 75/34; B65D 75/368; B65D 75/44; B65D 75/50; B65D 75/56; B65D 75/563; B65D 75/5811; B65D 75/5816; B65D 75/5872; B65D 75/5888; B65D 75/68; B65D 77/00; B65D 77/048; B65D 77/0486; B65D 77/08; B65D 77/10; B65D 77/2004; B65D 77/2008; B65D 77/2012; B65D 77/202; B65D 77/2028; B65D 77/2036; B65D 77/204; B65D 77/2044; B65D 77/2048; B65D 77/2052; B65D 77/206; B65D 77/2064; B65D 77/2076; B65D 77/2084; B65D 77/2092; B65D 77/2096; B65D 77/22; B65D 77/225; B65D 77/28; B65D 79/005; B65D 79/0087; B65D 81/027; B65D 81/051; B65D 81/075; B65D 81/127; B65D 81/1275; B65D 81/2007; B65D 81/2053; B65D 81/2092; B65D 81/22; B65D 81/245; B65D 81/30; B65D 81/3222; B65D 81/3227; B65D 81/3233; B65D 81/3238; B65D 81/3244; B65D 81/3407; B65D 81/3415; B65D 81/3438; B65D 81/3469; B65D 81/3476; B65D 81/3484; B65D 81/3492; B65D 81/361; B65D 81/363; B65D 81/3813; B65D 81/3816; B65D 81/3818; B65D 81/382; B65D 81/3827; B65D 81/383; B65D 81/3834; B65D 81/3848; B65D 81/3853; B65D 81/3858; B65D 81/386; B65D 81/3862; B65D 81/3879; B65D 81/3897; B65D 83/0841; B65D 83/0847; B65D 83/0882; B65D 83/141; B65D 83/76; B65D 83/768; B65D 85/08; B65D 85/38; B65D 85/54; B65D 85/544; B65D 85/74; B65D 85/78; B65D 85/80; B65D 85/804; B65D 85/8043; B65D 85/8046; B65D 85/8052; B65D 85/808; B65D 88/00; B65D 9/06; B65D 9/12; B65D 9/30; B65D 90/00

USPC ..... 206/0.5, 0.8, 0.81, 0.83, 0.84, 1.5, 1.7, 206/1.8, 118, 124, 139, 140, 141, 144, 206/145, 147, 149, 150, 151, 153, 155, 206/156, 158, 161, 162, 163, 168, 170, 206/180, 187, 19, 192, 193, 194, 196, 206/198, 199, 200, 203, 204, 205, 207, 206/209, 210, 211, 213.1, 214, 215, 216, 206/217, 218, 219, 223, 224, 225, 227, 206/229, 232, 233, 234, 236, 242, 246, 206/249, 254, 256, 259, 264, 265, 267, 206/268, 271, 273, 277, 278, 279, 288, 206/289, 292, 294, 297, 299, 3, 301, 303,

206/305, 307, 307.1, 308.1, 308.2, 308.3, 206/309, 310, 311, 312, 313, 315.1, 206/315.9, 316.1, 316.2, 317, 319, 320, 206/321, 326, 335, 338, 339, 340, 349, 206/350, 352, 362, 362.1, 363, 364, 365, 206/366, 369, 37, 370, 371, 372, 373, 206/379, 38, 380, 382, 386, 387.1, 206/387.13, 387.14, 389, 391, 392, 394, 206/396, 397, 40, 402, 407, 408, 409, 206/418, 419, 422, 423, 424, 425, 426, 206/427, 428, 429, 431, 432, 433, 434, 206/438, 439, 440, 443, 445, 446, 447, 206/448, 449, 45.2, 45.21, 45.22, 45.23, 206/45.24, 45.25, 45.27, 45.28, 45.29, 206/45.3, 451, 453, 454, 455, 456, 457, 206/459.1, 459.5, 460, 461, 462, 463, 206/464, 466, 467, 468, 469, 470, 471, 206/472, 473, 474, 476, 478, 479, 480, 206/482, 483, 484, 484.4, 484.2, 485, 206/486, 488, 489, 493, 494, 495, 496, 206/497, 499, 5, 501, 502, 503, 504, 505, 206/506, 507, 508, 509, 510, 511, 512, 206/513, 514, 515, 516, 518, 519, 520, 206/521, 521.1, 521.15, 521.2, 521.3, 206/521.4, 521.6, 521.7, 521.8, 521.9, 206/522, 523, 524.1, 524.2, 524.3, 524.4, 206/524.6, 524.7, 524.8, 525, 526, 527, 206/528, 530, 531, 532, 534, 534.1, 538, 206/539, 540, 541, 542, 545, 546, 548, 206/549, 550, 551, 553, 554, 555, 556, 206/557, 558, 559, 560, 561, 562, 563, 206/564, 565, 566, 567, 568, 569, 570, 206/571, 572, 575, 576, 577, 579, 581, 206/583, 584, 585, 586, 587, 588, 589, 206/590, 591, 592, 593, 594, 597, 598, 206/599, 6.1, 600, 63.3, 63.5, 701, 703, 206/705, 706, 707, 709, 710, 713, 714, 206/718, 720, 722, 723, 724, 725, 726, 206/728, 731, 732, 733, 734, 736, 738, 206/740, 741, 743, 744, 745, 746, 747, 206/748, 750, 751, 755, 756, 757, 758, 206/759, 760, 761, 762, 763, 764, 765, 206/766, 767, 768, 769, 77.1, 770, 772, 206/773, 774, 775, 776, 777, 778, 779, 206/780, 782, 783, 784, 8, 800, 804, 805, 206/806, 807, 812, 813, 814, 815, 817, 206/818, 819, 820, 821, 822, 823, 831, 206/86, 91, 92, 94, 96, 142, 175, 183, 206/388, 524.9, 811; 99/295, 323.5, 99/323.7, 323.8, 324, 325, 331, 332, 334, 99/336, 337, 339, 341, 342, 344, 347, 99/355, 357, 358, 359, 372, 380, 400, 99/401, 403, 407, 408, 410, 411, 413, 99/416, 422, 423, 425, 426, 427, 443 C, 99/443 R, 444, 445, 446, 447, 448, 449, 99/450, 450.1, 451, 467, 468, 472, 473, 99/475, 480, 481, 483, 485, 486, 487, 99/494, 513, 516, 537, 538, 547, DIG. 14; 220/17.1, 201, 203.08, 203.11, 203.17, 220/211, 212, 212.5, 23.2, 23.4, 23.6, 220/23.8, 23.83, 23.86, 23.87, 23.88, 220/23.89, 254.2, 254.3, 254.7, 260, 263, 220/264, 266, 268, 270, 281, 3.94, 314, 220/315, 324, 351, 359.1, 359.2, 359.3, 220/359.4, 360, 364, 366.1, 367.1, 368, 220/373, 374, 375, 377, 379, 380, 4.01, 220/4.21, 4.22, 4.23, 4.24, 4.26, 4.27, 220/4.28, 480, 481, 495.01, 495.02, 220/495.03, 495.04, 495.06, 500, 501, 220/503, 507, 516, 521, 522, 523, 524, 220/526, 528, 529, 530, 533, 555, 556, 220/557, 560.01, 570, 572, 573.1, 573.2, 220/573.4, 574, 574.3, 575, 577, 592.03, 220/592.17, 592.23, 592.25, 600, 601, 220/602, 605, 608, 62, 62.1, 62.11, 62.12, 220/62.13, 62.14, 62.2, 62.22, 626, 628, 220/630, 635, 639, 640, 645, 649, 657, 220/659, 660, 662, 665, 669, 675, 676, 220/678, 694, 703, 705, 709, 713, 719, 220/729, 731, 735, 737, 738, 739, 745, 220/751, 752, 754, 755, 757, 759, 771, 220/772, 781, 787, 789, 791, 793, 8, 802, 220/825, 833, 839, 89.1, 902, 903, 908, 220/910, 912, 914, 915.1, 917, 918, 220/DIG. 13, DIG. 30, DIG. 5, DIG. 6, 220/FOR. 186; 224/236, 245, 270, 275, 224/282, 400, 407, 42.3, 483, 525, 526, 224/537, 544, 547, 549, 550, 553, 554, 224/557, 558, 561, 562, 564, 565, 566, 224/571, 572, 601, 602, 605, 615, 616, 224/623, 671, 681, 901.2, 901.4, 901.8, 224/906, 926, 928; 426/100, 101, 103, 426/104, 106, 107, 108, 109, 110, 111, 426/112, 113, 114, 115, 118, 119, 120, 426/121, 122, 123, 124, 125, 126, 127, 426/128, 129, 130, 131, 132, 133, 135, 426/138, 139, 14, 18, 19, 2, 20, 231, 232, 426/233, 234, 235, 237, 238, 241, 243, 426/244, 250, 262, 279, 282, 283, 284, 426/289, 292, 302, 307, 310, 312, 316, 426/318, 319, 320, 322, 323, 326, 330.3, 426/330.4, 330.5, 331, 332, 334, 335, 35, 426/383, 386, 388, 389, 392, 393, 394, 426/395, 396, 397, 398, 399, 404, 407, 426/410, 411, 412, 413, 415, 416, 418, 426/419, 425, 426, 438, 439, 44, 443, 45, 426/451, 459, 460, 466, 472, 480, 484, 426/489, 49, 496, 497, 505, 507, 511, 426/514, 515, 516, 518, 520, 523, 524, 426/531, 532, 549, 551, 557, 564, 565, 426/568, 573, 574, 576, 578, 581, 589, 426/592, 601, 603, 61, 614, 615, 618, 62, 426/629, 631, 634, 637, 638, 641, 646, 426/654, 655, 661, 665, 68, 76, 808, 87, 426/88, 89, 90, 92, 93, 94, 96, 98

See application file for complete search history.

(56) References Cited

U.S. PATENT DOCUMENTS

| | | | | | |
|---|---|---|---|---|---|
| 3,985,230 | A * | 10/1976 | Meyer | ..... | B65D 5/6664 206/424 |
| 10,647,467 | B1 * | 5/2020 | Tibbets | ..... | B31F 1/0038 |
| 11,691,778 | B2 * | 7/2023 | Zwaga | ..... | B65D 5/243 229/113 |

FOREIGN PATENT DOCUMENTS

| | | | | | |
|---|---|---|---|---|---|
| EP | 1604903 | A2 * | 12/2005 | ..... | B65D 5/443 |
| EP | 3744654 | A1 | 12/2020 | | |
| FR | 3016347 | A1 * | 7/2015 | ..... | B65D 5/243 |
| WO | WO-2019179930 | A1 * | 9/2019 | ..... | B65D 5/2047 |

* cited by examiner

CARDBOARD TRAY

CROSS REFERENCE TO RELATED APPLICATIONS

This application is the United States national phase of International Patent Application No. PCT/EP2022/058644 filed Mar. 31, 2022, and claims priority to European Patent Application No. 21172491.9 filed May 6, 2021, the disclosures of which are hereby incorporated by reference in their entireties.

BACKGROUND OF THE INVENTION

Field of the Invention

The invention relates to a cardboard tray folded from an unfolded sheet of cardboard, which tray comprises:

- a bottom wall with a circumferential edge composed out of a number of straight edges;
- wall parts each arranged to a straight edge of the bottom wall;
- first flange parts at least arranged to opposite wall parts along the circumferential edge, which first flange parts are arranged to an edge of said wall part opposite of, and preferably parallel to, the respective straight edge of the bottom wall;

wherein the first flange parts comprise at least a first, a second and third elongate flange part section, which are connected parallel and along an elongate edge to each other, wherein, for each first flange part, the first elongate flange part section is arranged to a respective wall part, the second elongate flange part section is double folded against the first elongate flange part section, and the third elongate flange part section is connected parallel and along an elongate edge to the second elongate flange part section.

Description of Related Art

Such a cardboard tray is known from WO 2019-179930. In this known cardboard tray, the second and third elongate flange part section are folded outwardly and the third elongate flange part section is adhered to the outside of the wall parts of the cardboard tray. As a result, the outside of the wall parts are at least partially covered by the third flange part section, such that the surface of the wall parts cannot fully be used for printing. The used unfolded sheet of cardboard cannot always be printed on two sides to overcome the above problem, as one printed side would get into contact with the products carried in the cardboard tray. In addition, two sided printing increases the costs of the cardboard tray.

Another disadvantage of the known cardboard tray is that the outwardly folding of the flange part sections prevents or at least severely limits the possibilities to fold the cardboard tray from an unfolded sheet of cardboard in a inline application. Typically the known cardboard trays need to be folded separately and then fed to an inline application, such as a conveyor belt with an inline filling station and an inline sealing station.

SUMMARY OF THE INVENTION

It is an object to reduce or even remove the above mentioned disadvantages.

This object is achieved according to the invention with a cardboard tray according to the preamble, which is characterized in that for each first flange part the third elongate flange part section is adhered to the respective wall part on the inside of the cardboard tray and the second elongate flange part section is sloping downwards from the third elongate flange part section towards the first elongate flange part section.

With the invention the third flange part section is folded to the inside and adhered to the wall part on the inside of the cardboard tray. As a result the outer surface of the wall part is no longer partially covered and thus can be printed over the full surface of the wall part.

Also, the arrangement of the third flange part section on the inside of the cardboard tray allows for folding the cardboard tray with an inline application. Because the third flange part section is folded to the inside, the cardboard tray can be supported on a single side, i.e. the outside, when the wall parts and flange part sections are folded and the third flange part section is adhered to the wall part on the inside of the cardboard tray.

The downwards sloping second elongate flange part section allows for providing a top seal foil under tension by forcing the second elongate flange part section in a horizontal position when sealing the top seal foil and then allow the second elongate flange part section to bend to the sloping position.

In a preferred embodiment of the cardboard tray according to the invention the fold line between the second and third elongate flange part section is spaced apart and positioned, relative to the bottom wall, above the fold line between the first flange part section and the wall part.

The resulting cross-section of the first flange part is triangular and provides strength to the flange. This allows for heavier products to be carried in the cardboard tray or for using a thinner cardboard sheet.

Preferably, the width of the second flange part section is larger than the width of the first flange part section.

In yet another embodiment of the cardboard tray according to the invention the third flange part section extends to the bottom wall, covering the respective wall part.

By extending the third flange part section to the bottom wall a smooth inner surface is provided without any transitions in thickness.

In a further preferred embodiment of the cardboard tray according to the invention second flange parts are alternately arranged with the first flange parts to subsequent wall parts along the circumferential edge to provide a circumferential flange.

The first flange parts allow for tensioning the top seal foil, while the circumferential flange allows for airtight sealing of the top seal foil.

In yet a further preferred embodiment of the cardboard tray according to the invention the longitudinal ends of the second flange parts overlap with the longitudinal ends of the first flange part sections of the first flange parts.

The overlapping parts can be adhered to each other to provide additional strength in the circumferential flange and also allow for aligning the second flange part section of the first flange part with the second flange part in a horizontal plane, such that a flat, continuous sealing surface for the top seal foil is provided.

The adhesive for adhering the overlapping longitudinal ends could be a glue, hotmelt or seal lacquer. In case a seal lacquer is used, the cardboard could slow down the heat from a heating element to warm up the seal lacquer. In such a case, the longitudinal end being in direct contact with the heating element could be provided with a perforation or slits, such that the heat from the heating element could more easily pass towards the seal lacquer present on the contact surface between the two longitudinal ends. Preferably, the longitudinal edges of the second flange parts abut to the longitudinal edges of the second flange part sections of the first flange parts.

In another embodiment of the cardboard tray according to the invention the combined angle of two abutting longitudinal edges is larger than 90°. With a combined angle larger than 90° the abutting edges will support the downward sloping second flange part section, such that not all tension is taken by the third flange part section.

In still a further embodiment of the cardboard tray according to the invention the second and third flange part sections of each first flange part have been removed and wherein the longitudinal edges of the second flange parts abut to the longitudinal edges of the first flange part sections of the first flange parts and wherein the combined angle of two abutting longitudinal edges is larger than 90°.

Because the combined angle larger than 90° ensures that the abutting edges will support the downward sloping first flange part section, the tension in the top seal foil could be maintained without the additional support of the second and third flange part section.

Preferably, a foil is laminated to the inside the cardboard tray onto the bottom wall, the wall parts and to the first and second flange parts. This laminated foil will keep the longitudinal edges in abutting position and keeps the first flange part in the downward sloping position. This ensures that prior to arranging a top seal foil, the flange parts are maintained in the desired position.

BRIEF DESCRIPTION OF THE DRAWINGS

These and other features of the invention will be elucidated in conjunction with the accompanying drawings.

The terms Fig., Figs., Figure, and Figures are used interchangeably in the specification to refer to the corresponding figures in the drawings.

DESCRIPTION OF THE INVENTION

Figure 1:
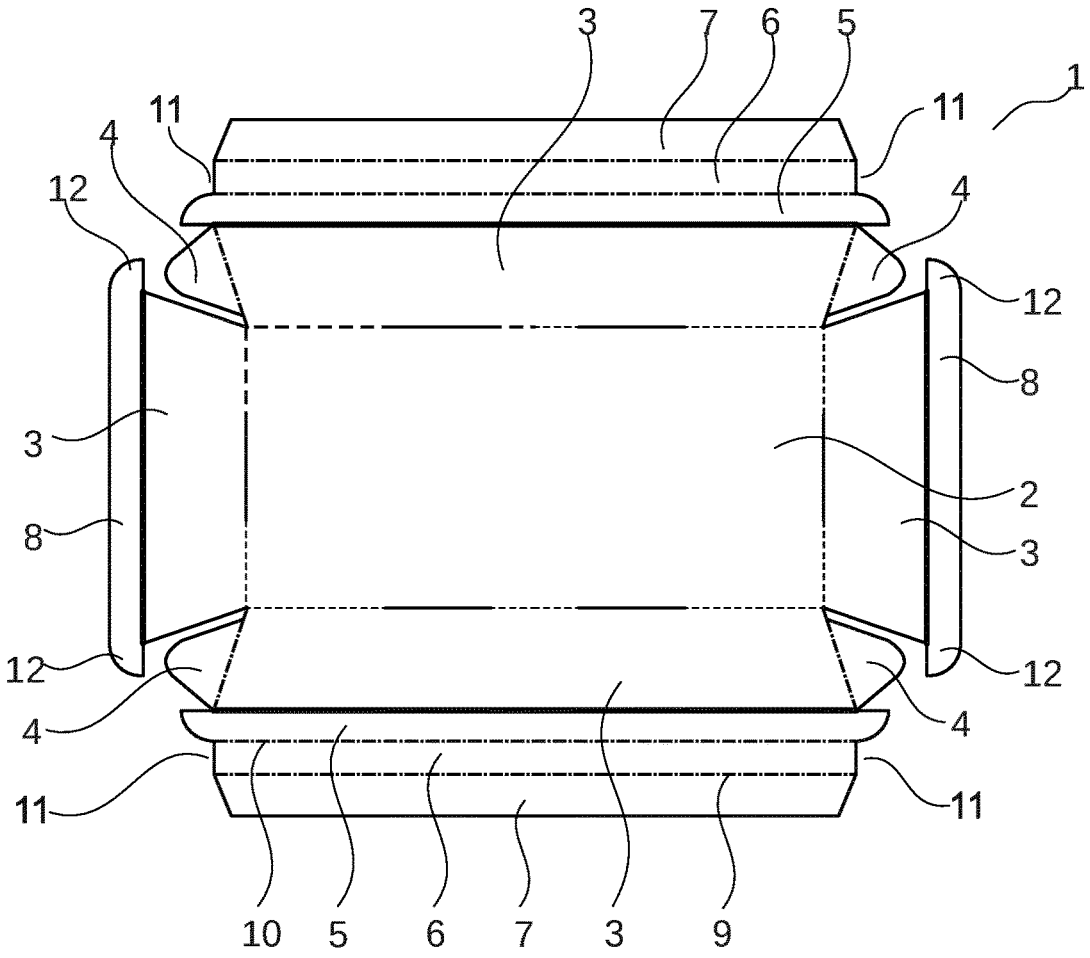
FIG. 1 shows an unfolded sheet for a first embodiment of a cardboard tray according to the invention.

FIG. 1 shows an unfolded sheet 1 for a first embodiment of a cardboard tray according to the invention. The sheet 1 has a bottom wall 2, four wall parts 3, which are attached to the bottom wall 2 and provided with glue flaps 4, with which the wall parts 3 can be arranged to each other. These glue flaps 4 can be folded onto the outside of the adjacent wall parts 3 or onto the inside of said wall parts 3. The glue flaps 4 can even be omitted, especially when a foil is laminated onto the inside of the tray 1.

First flange parts 5, 6, 7 are arranged on two opposite sides of the bottom wall 2, as well as two second flange parts 8.

Figure 2:
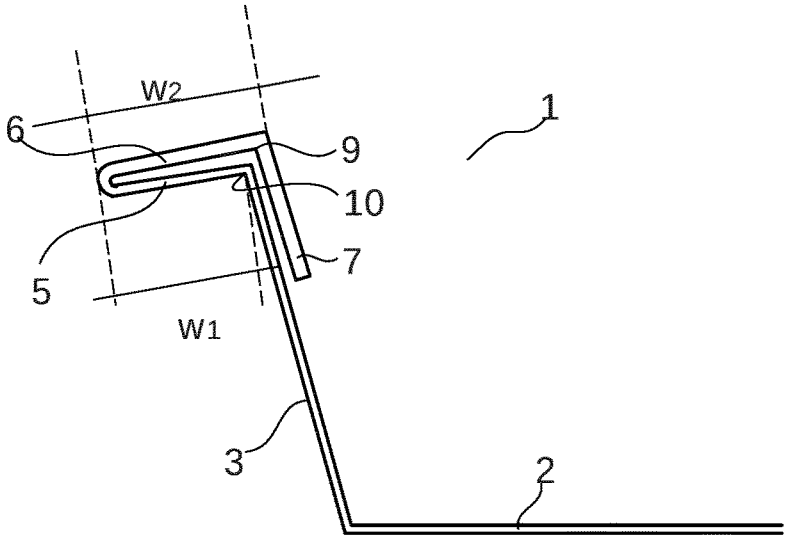
FIG. 2 shows a cross-section of the cardboard tray of FIG. 1 in folded position.

FIG. 2 shows a cross-section of the sheet 1 folded into a cardboard tray according to the invention. The first flange part has a first elongate flange part section 5 extending outwardly from the tray, a second elongate flange part section 6 folded double and a third elongate flange part section 7 folded onto the inside of the tray onto the wall part 3.

The width $w_1$ of the first flange part section 5 is smaller than the width $w_2$ of the second flange part section 6, such that the second flange part section 6 will slope downward. The fold line 9 is space apart and positioned above the fold line 10, such that a triangular cross-section is obtained for the first flange part 5, 6, 7. By changing the ratio of the width $w_1$ and width $w_2$, the angle of sloping second flange part section 6 can be defined. Preferably, the angle is about 20° to 30°. But the flange could also have an angle nearing 0°.

Figure 3:
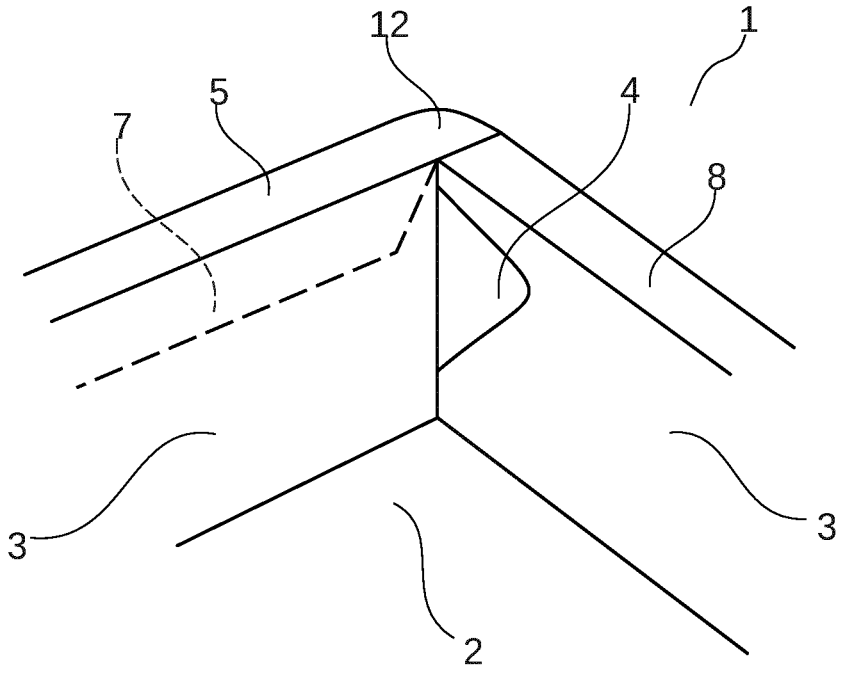
FIG. 3 shows the folded tray of FIG. 1 in perspective view from below.
Figure 4:
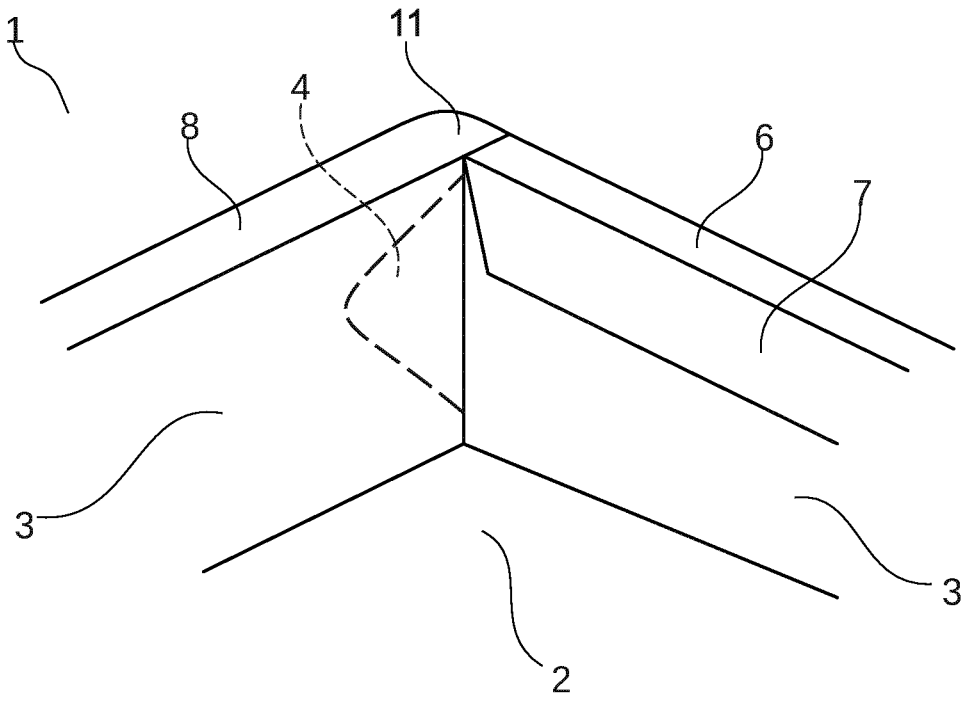
FIG. 4 shows the folded tray of FIG. 1 in perspective view from above.

FIG. 3 shows the folded tray 1 from below. The longitudinal end 11 of the second flange part section 6 overlaps with the longitudinal end 12 of the second flange part 8. As shown in FIG. 3, the longitudinal end 12 is positioned below the longitudinal end 11 (see also FIG. 4). By adhering the two longitudinal ends 11, 12 to each other, additional strength is obtained. The adhesive, such as glue, hotmelt or seal lacquer can be provided onto the longitudinal ends 11, 12 in order to attach the flange parts to each other during folding the flanges. The flange parts can also be attached to each other during a top seal process, which is applied after the tray 1 is filled.

Figure 5:
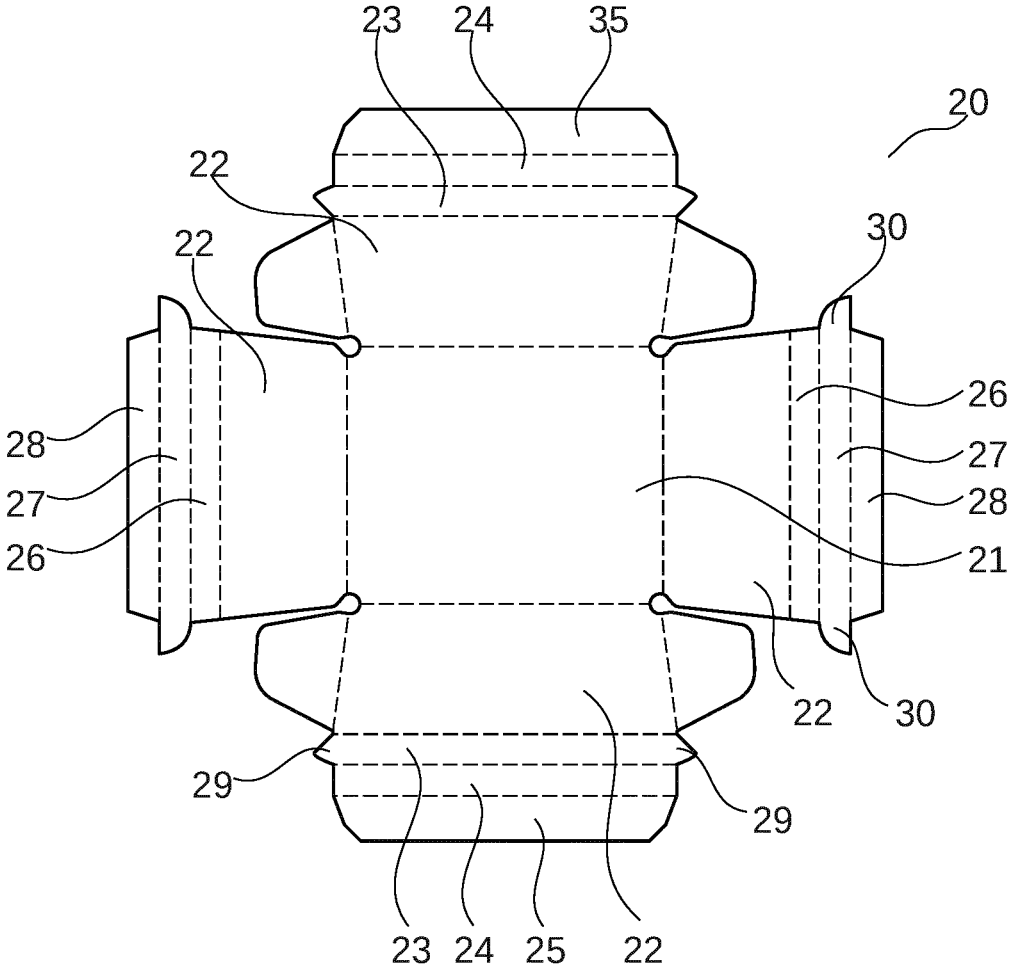
FIG. 5 shows an unfolded sheet for a second embodiment of a cardboard tray according to the invention.

FIG. 5 shows an unfolded sheet 20 of a second embodiment of a cardboard tray according to the invention. The tray 20 has a bottom wall 21, wall parts 22 and alternately first flange parts 23, 24, 25 and second flange parts 26, 27, 28.

Figure 6:
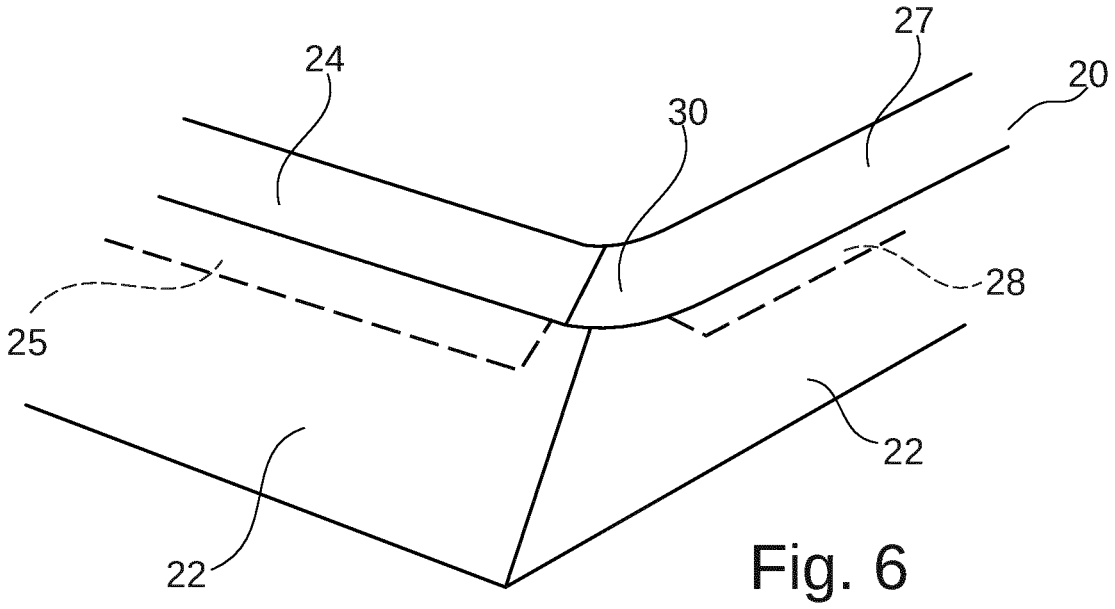
FIG. 6 shows a perspective view of the tray of FIG. 5 in folded position.

Each of the first flange parts 23, 24, 25 and second flange parts 26, 27, 28 have a first flange part section 23, 26 extending outwardly from the folded tray 20, a second flange part section 24, 27 folded double and a third flange part section 25, 28 folded into the inside of the tray 20 and against a respective wall part 22. (see also FIG. 6)

The first flange part section 23 has extending longitudinal ends 29 which overlap with the longitudinal ends 30 of the second flange part section 27, such that a flat, uninterrupted peripheral flange is provided, for example for airtight sealing of a top foil.

Figure 7:
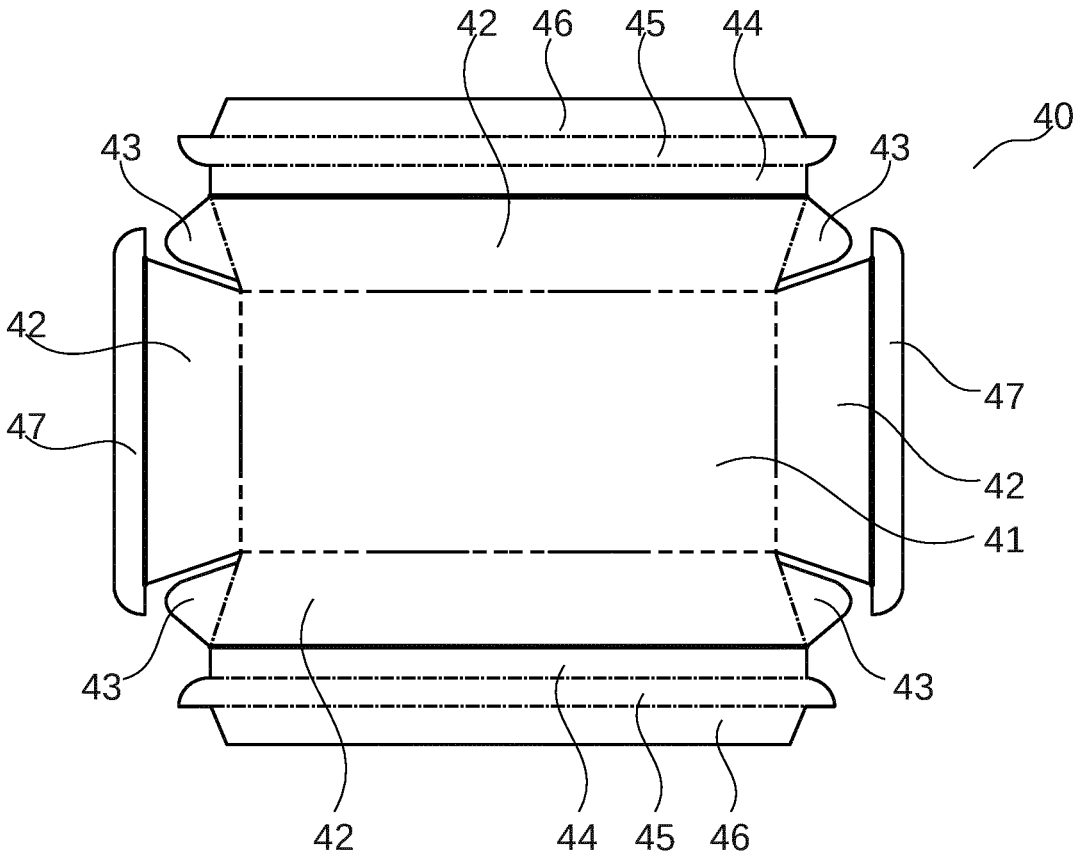
FIG. 7 shows an unfolded sheet for a third embodiment of a cardboard tray according to the invention.

FIG. 7 shows an unfolded sheet 40 for a third embodiment of a cardboard tray according to the invention. The tray 40 has a bottom wall 41, wall parts 42 with glue flaps 43 and first flange parts 44, 45, 46 and second flange parts 47.

Figure 8A:
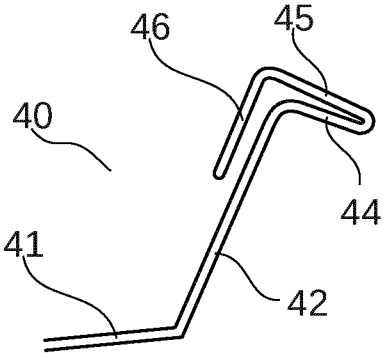
FIGS. 8A and 8B show a cross-section of the cardboard tray of FIG. 7 in folded position.

As shown in FIG. 8A, the first flange part has a first flange part section 44 extending outwardly, a second flange part section 45 folded double and a third flange part section folded inwardly into the tray 40 onto the wall part 42.

Figure 8B:
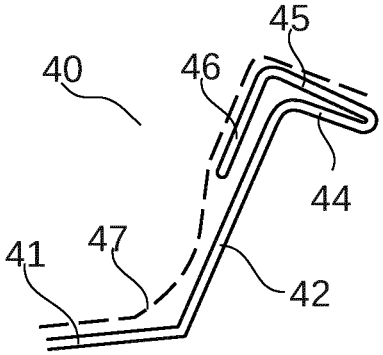

FIG. 8B shows a variant to FIG. 8A in that in addition a foil 47 is laminated onto the bottom wall 41, wall parts 42 and second flange part section 45. The foil 47 contributes in maintaining the first flange part 44, 45, 46 in the downward sloping position.

Figure 9:
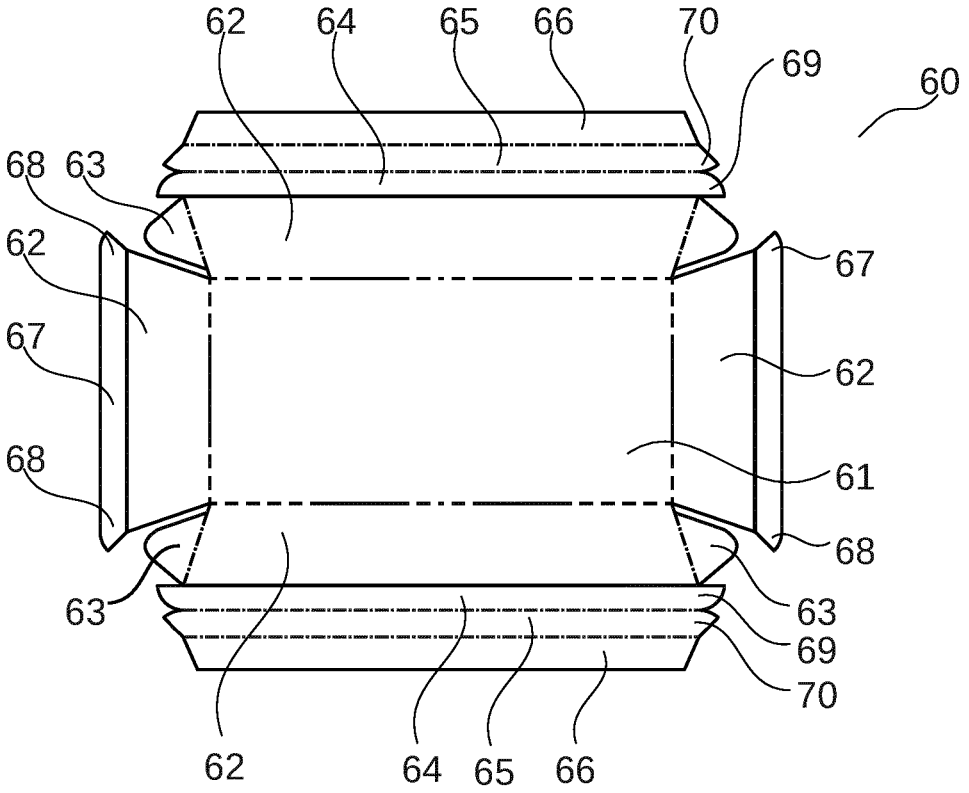
FIG. 9 shows an unfolded sheet for a fourth embodiment of a cardboard tray according to the invention.
Figure 10:
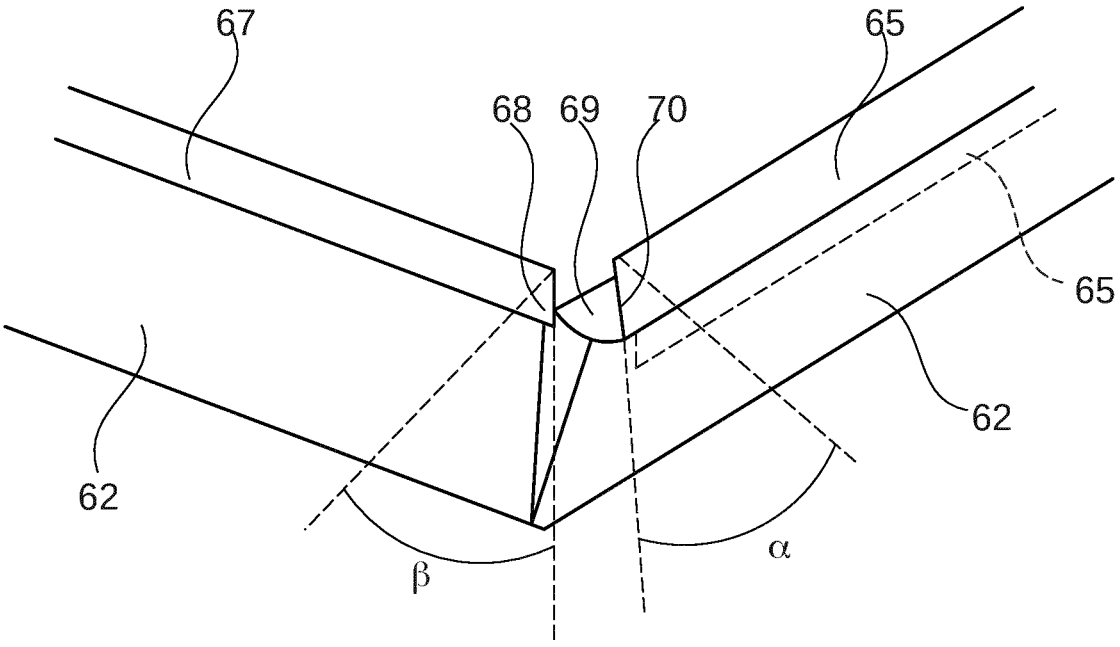
FIG. 10 shows a perspective view of the tray of FIG. 9 in folded position.

FIG. 9 shows an unfolded sheet 60 for a fourth embodiment of a cardboard tray according to the invention.

The tray 60 has a bottom wall 61, wall parts 62 with glue flaps 63, opposite arranged first flange parts 64, 65, 66 and opposite arrange second flange parts 67.

The second flange part 67 has extending longitudinal ends 68, which overlap with the extending longitudinal ends 69 of the first flange part section 64 and abut against the longitudinal edges 70 of the second flange part section 65.

The angle $\alpha$ of the longitudinal edge 70 combined with the angle $\beta$ is larger than 90°, such that both second flange part section 65 and second flange part 67 are urged to slope downward.

Figure 11A:
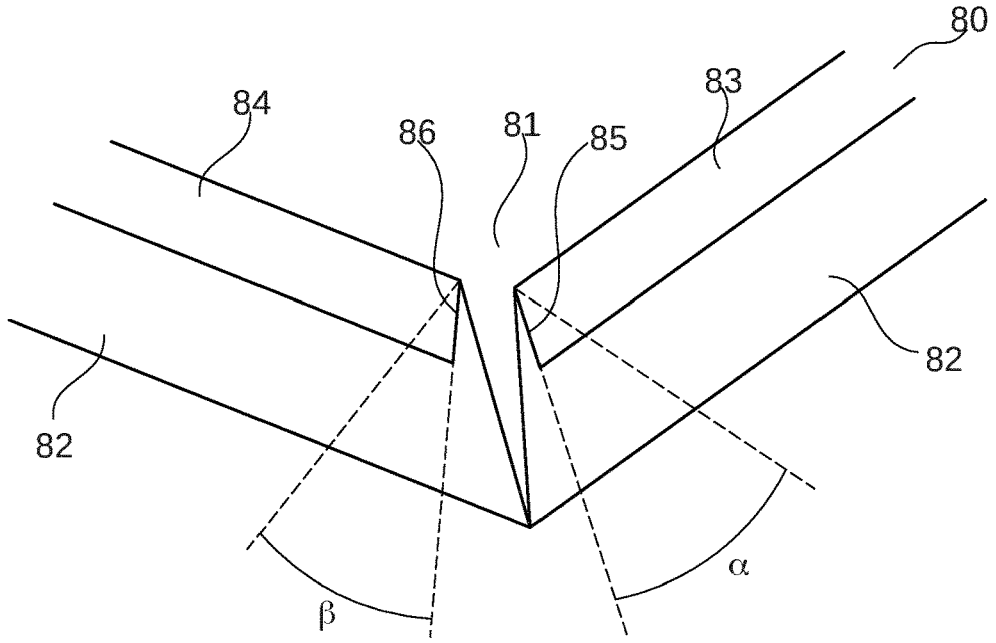
FIGS. 11A-11C show details of a fifth embodiment of a cardboard tray according to the invention.
Figure 11B:
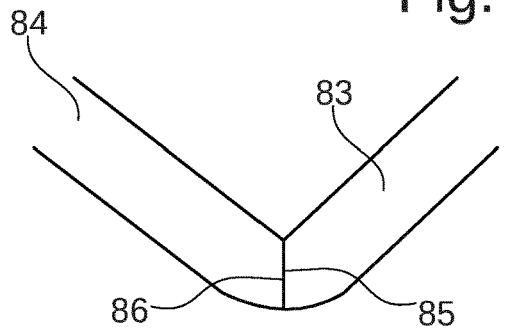
Figure 11C:
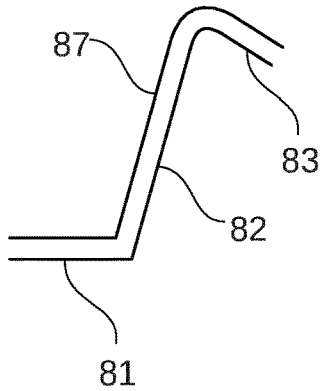

FIGS. 11A-11C show a fifth embodiment 80 of a tray according to the invention. The tray 80 has a bottom wall 81 and wall parts 82 each provided at the top with a first flange part section 83, 84 (the second and third flange part section are removed).

The longitudinal edge 85 of the first flange part section 83 has an angle $\alpha$ and the longitudinal edge 86 of the first flange part section 84 has an angle $\beta$.

When the card board tray 80 is arranged in a mould (not shown), the longitudinal edges 85, 86 will be pressed against each other (see FIG. 11B). By laminating a foil 87 against the bottom 81, wall part 82 and flange parts 83, this position is fixed. When in addition the combined angles $\alpha$ and $\beta$ is larger than 90°, the flange parts 83, 84 will slope downward providing additional strength to the tray.

Figure 12:
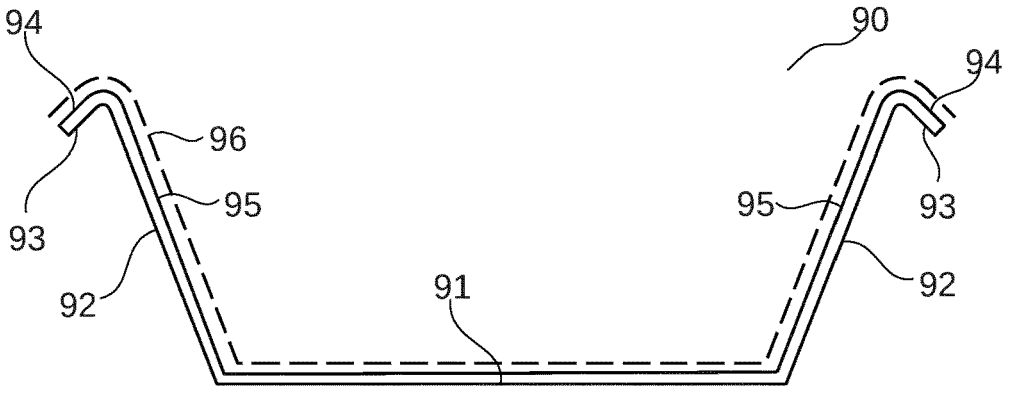
FIG. 12 shows a cross-section of a sixth embodiment of a cardboard tray according to the invention.

FIG. 12 shows a cross-section of a sixth embodiment 90 of a cardboard tray according to the invention. The tray 90 has a bottom wall 91 with upstanding wall parts 92. To the top of the wall parts 92, a first flange part 93, 94, 95 is arranged. The first flange part has a first flange part section 93 extending outwardly, a second flange part section 94 folded double with the first flange part section 93 and a third flange part section 95 extending along the full height of the wall part 92 and on the inside of the tray 90. This ensures that the tray 90 has both on the outside as well as on the inside an uninterrupted surface. A foil 96 has been laminated onto the bottom wall 91, the wall parts 92 and the second flange part section 94 in order to contribute in maintaining the flange in the downward sloping position.

Figure 13:
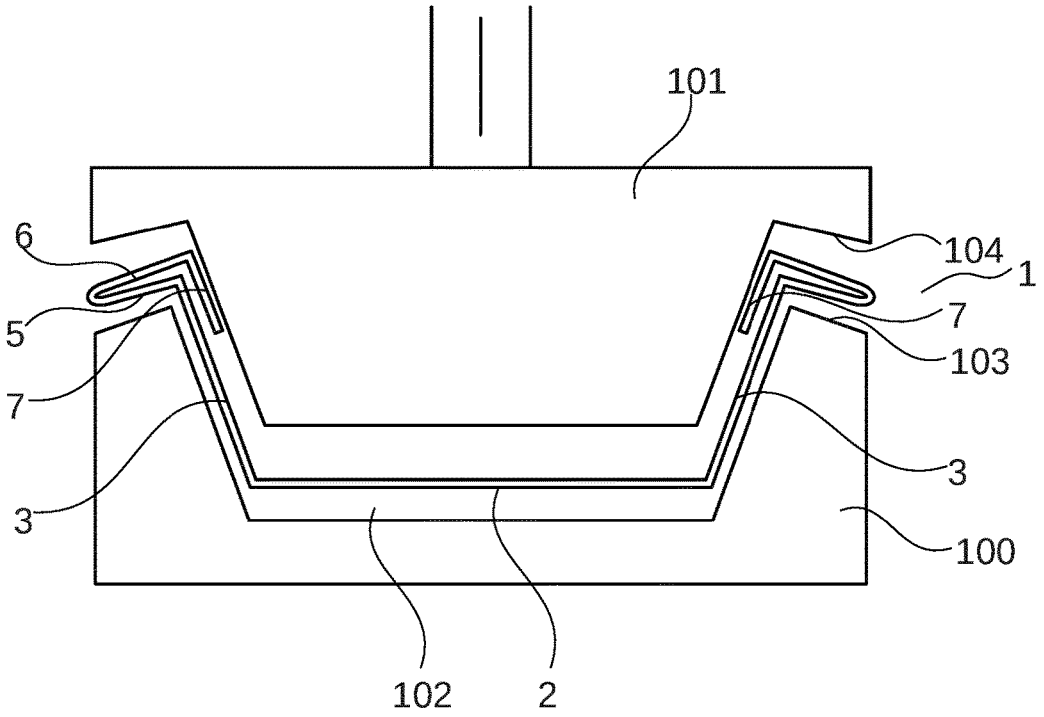
FIG. 13 shows schematically a first method of adhering the third flange part section to a wall part.

FIG. 13 shows schematically a first method of adhering the third flange part section 7 to a wall part 3 of a tray 1 as shown in FIGS. 1 and 2. A bottom mould 100 and a top mould 101 movable up and down is provided. The bottom mould 100 is provided with a recess 102 and an edge 103 bordering the recess 102. The top mould 101 is provided with a inverse shape from the bottom mould 100 and has a flange 104 cooperating with the edge 103.

The edge 103 and flange 104 slope downward, such that when the tray 1 is pressed between both moulds 100, 101, the third flange part section 7 is adhered to the wall part 3. When the adhesive has set, the tray 1 will maintain its shape with downward sloping flange 5, 6, 7.

Figure 14:
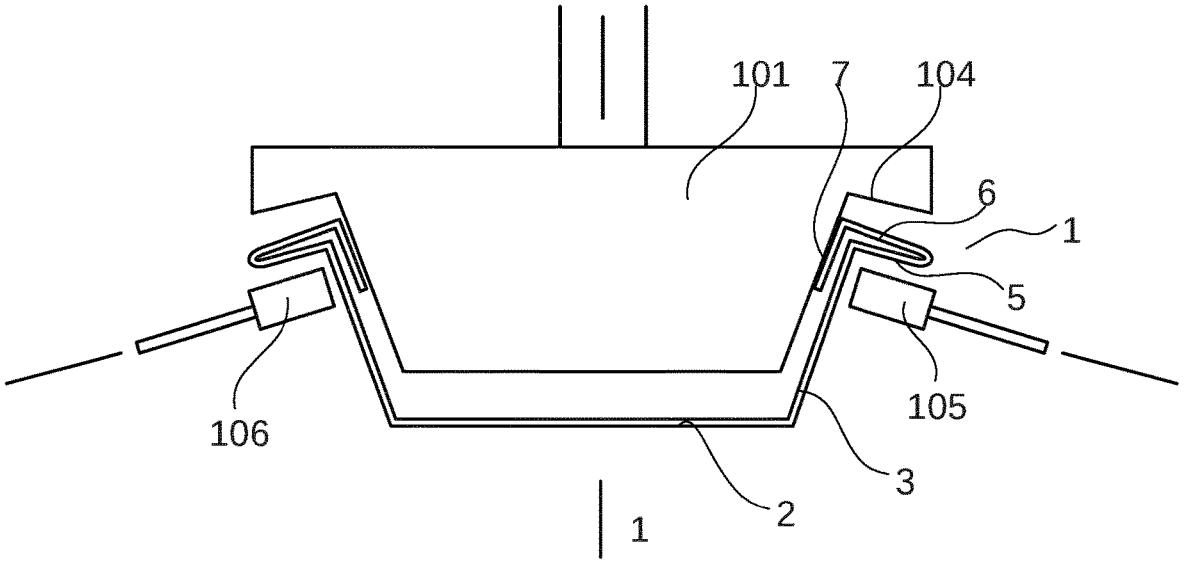
FIG. 14 shows schematically a second method of adhering the third flange part section to a wall part.

FIG. 14 shows schematically a second method of adhering the third flange part section 7 to a wall part 3. To this end, the same top mould 101 is used in combination with two support rails 105, 106 which can be moved sideways. After the flanges 5, 6, 7 of the tray 1 have been compressed between the flange 104 and the support rails 105, 106, and the adhesive has set, the support rails 105, 106 are moved sideways, such that the tray 1 can fall down onto a conveyor for example.

The invention claimed is:

1. A cardboard tray folded from an unfolded sheet of cardboard, which tray comprises:

a bottom wall with a circumferential edge composed out of a number of straight edges;

wall parts each arranged to a straight edge of the bottom wall; and first flange parts at least arranged to opposite wall parts along the circumferential edge, which first flange parts are arranged to an edge of said wall part opposite of, and preferably parallel to, the respective straight edge of the bottom wall;

wherein the first flange parts comprise at least a first, a second and third elongate flange part section, which are connected parallel and along an elongate edge to each other, wherein, for each first flange part, the first elongate flange part section is arranged to a respective wall part, the second elongate flange part section is double folded against the first elongate flange part section, and the third elongate flange part section is connected parallel and along an elongate edge to the second elongate flange part section, and wherein for each first flange part the third elongate flange part section is adhered to the respective wall part on the inside of the cardboard tray and the second elongate flange part section is sloping downwards from the third elongate flange part section towards the first elongate flange part section, and the second elongate flange part section is configured to move to a horizontal position when a top seal foil under tension is applied to the first flange parts and, then subsequently, return to sloping downwards from the third elongate flange part section toward the first elongate flange part section.

2. The cardboard tray according to claim 1, wherein the fold line between the second and third elongate flange part section is spaced apart and positioned, relative to the bottom wall, above the fold line between the first elongate flange part section and the wall part.

3. The cardboard tray according to claim 1, wherein the width of the second elongate flange part section is larger than the width of the first elongate flange part section.

4. The cardboard tray according to claim 1, wherein the third elongate flange part section extends to the bottom wall, covering the respective wall part.

5. The cardboard tray according to claim 1, wherein second flange parts are alternately arranged with the first flange parts to subsequent wall parts along the circumferential edge to provide a circumferential flange.

6. The cardboard tray according to claim 5, wherein the longitudinal ends of the second flange parts overlap with the longitudinal ends of the first elongate flange part sections of the first flange parts.

7. The cardboard tray according to claim 6, wherein the longitudinal edges of the second flange parts abut to the longitudinal edges of the second elongate flange part sections of the first flange parts.

8. The cardboard tray according to claim 7, wherein the combined angle of two abutting longitudinal edges is larger than 90°.

9. The cardboard tray according to claim 5, wherein the second and third elongate flange part sections of each first flange part have been removed and wherein the longitudinal edges of the second flange parts abut to the longitudinal edges of the first elongate flange part sections of the first flange parts and wherein the combined angle of two abutting longitudinal edges is larger than 90°.

10. The cardboard tray according to claim 9, wherein a foil is laminated to the inside of the cardboard tray onto the bottom wall, the wall parts and to the first and second flange parts.

* * * * *